United States Patent [19]

Rennhack

[11] Patent Number: 4,596,609

[45] Date of Patent: Jun. 24, 1986

[54] THERMOMECHANICAL FORGING OF ALUMINUM ALLOYS

[75] Inventor: Elliott H. Rennhack, San Jose, Calif.

[73] Assignee: Lockheed Missiles & Space Company, Inc., Sunnyvale, Calif.

[21] Appl. No.: 589,520

[22] Filed: Mar. 14, 1984

[51] Int. Cl.[4] ..... C22F 1/04

[52] U.S. Cl. ..... 148/12.7 A; 148/415; 148/416; 148/417

[58] Field of Search ..... 148/12.7 A, 415–418

[56] References Cited

U.S. PATENT DOCUMENTS 4,092,181 5/1978 Paton et al. ..... 148/12.7 A

*Primary Examiner*—R. Dean

*Attorney, Agent, or Firm*—John J. Morrissey

[57] ABSTRACT

A thermomechanical method for forging a precipitation-hardenable aluminum alloy workpiece comprises the steps of: (1) solution heat treating the workpiece to achieve a substantially homnogeneous supersaturated solid solution of the alloy throughout the workpiece; (2) partially aging the workpiece at a temperature sufficient to cause second-phase precipitate particles to form in the workpiece, the aging of the workpiece continuing until the precipitate particles acquire a size sufficient to restrict dislocation movement in the workpiece during subsequent forging without substantially hindering workability of the alloy; and (3) mechanically working the workpiece isothermally at the temperature at which aging of the workpiece occurred.

9 Claims, No Drawings

THERMOMECHANICAL FORGING OF ALUMINUM ALLOYS

TECHNICAL FIELD

This invention pertains to the forging of percipitation-hardenable aluminum alloys.

BACKGROUND OF THE INVENTION

Fabrication of an object of complex configuration from an aluminum alloy is facilitated by closed-die forging of a billet of the alloy to produce a near-netshape, which then requires only minimal machine finishing to acquire a final shape. The forging process permits control of meta flow, and thereby permits control of the formation of metallurgical microstructures in localized areas so that directional properties of the crystal structure of the alloy can be made to conform to directional requirements of the particular application intended for the object being fabricated.

In the prior art, forging procedures for aluminum alloys were formulated primarily to achieve specific geometrical configurations, and were not generally designed for maximum efficiency in process scheduling or for obtaining optimum mechanical properties in the objects being fabricated. In the prior art, a forging schedule for an aluminum alloy typically included multiple forging sequences, intermediate stage reheating, a sizing or coining operation (depending upon the size and complexity of the object being fabricated), and a final heat-treatment sequence for thermal strengthening of the object.

Forging of an aluminum alloy is conventionally performed in a heated die at a temperature in the 370° C. to 470° C. range. If the alloy is of the precipitation-hardenable type (e.g., an aluminium alloy of the 2000, 6000 or 7000 series as described in standard texts such as *Alcoa Aluminum Handbook,* Second Edition, Aluminum Company of America, Pittsburgh, Pa. (1962)), the final heat-treatment sequence conventionally requires "aging" of the forged object at a temperature in the 120° C. to 200° C. range for a relatively long period of time, i.e., typically from 8 to 36 hours.

SUMMARY OF THE INVENTION

The present invention is a thermomechanical forging procedure for precipitation-hardenable aluminum alloys. This new forging procedure optimizes process scheduling in terms of manufacturing costs and energy consumption, and results in higher yield and ultimate strength levels than conventional forging procedures while maintaining substantially the same level of ductility.

In accordance with the present invention, a billet (or "workpiece") of a precipitation-hardenable aluminum alloy is first "solution heat treated" to produce a substantially homogeneous supersaturated solid solution of the alloy through the workpiece. For a definition of "solution heat treatment", see *Metals Handbook, Properties and Selection of Metals,* Vol. 1, 8th Edition, page 35, American Society for Metals, Metals Park, Novelty, Ohio (1961). A solution heat treatment sequence includes heating the workpiece at an elevated temperature, followed by rapid cooling of the workpiece as by water quenching. The heating sequence occurs at a temperature that depends upon the particular chemical composition of the aluminum alloy, and is typically at a temperature in the 400° C. to 535° C. temperature range.

The workpiece could be a blank of the alloy as delivered by the supplier, or it could be a partially forged preform. The solution heat treatment sequence typically requires from 0.5 to 1.0 hour, depending upon the thickness of the workpiece.

After the workpiece has been solution heat treated, (i.e., heated at the appropriate elevated temperature for the appropriate length of time and then water quenched), the workpiece is then partially aged (or "preaged") at a temperature lower than the solution heat treatment temperature, so that second-phase precipitate particles can nucleate and grow within the workpiece. The second-phase precipitate particles from one or more aging reactions occurring within the alloy serve to inhibit dislocation movement within the workpiece during a subsequent forging procedure. The preaging continues until the size of the precipitate particles is sufficient to restrict dislocation movement within the workpiece without the alloy becoming so hard and brittle as to be unworkable. The preaging typically requires from 0.5 to 1.5 hours.

After the workpiece has been preaged, it is then thermomechanically forged to the required shape in a die that has been heated to the temperature at which the alloy was preaged (i.e., the workpiece is isothermally forged). The thermomechanical forging procedure could involve press-forging of hammer-forging, and could be performed using a conventional tool-steel die.

The thermomechanical forging procedure of the present invention differs from forging procedures of the prior art primarily in using solution heat treated and preaged workpieces, rather than blanks of essentially uncontrolled thermal condition.

Depending upon the composition of the aluminum alloy, the forged workpiece can be subsequently heat-treated in a "post-forge aging" step to complete the precipitation reaction or reactions. Post-forge aging typically requires heat-treatment at a temperature in the 150° C. to 200° C. range for 0.5 to 2.0 hours.

Forging of the workpiece at the preaging temperature serves to increase solute diffusion rates within the alloy, and thereby reduces the time required to complete the aging process. This reduction in time required for the aging process enables cost reductions to be achieved in manufacturing operations, and significantly reduces energy consumption.

Forging of the workpiece at the preaging temperature also produces microstructural refinement within the alloy, and improves the distribution of the hardening phase. These factors co-act synergistically to promote a significant increase in strength of the alloy.

BEST MODE OF CARRYING OUT THE INVENTION

The thermomechanical forging procedure of the present invention has been carried out using workpieces of different aluminum alloys. Objects fabricated using this thermomechanical forging procedure have dramatically greater strength than, while maintaining a ductility comparable to that of, similar objects forged in the conventional manner from the same alloys.

A small rolled plate-section made of 2219 aluminum alloy was solution heat treated fron one hour at 532° C., water quenched, and then preaged for one hour at 163° C. to develop a dispersion of second-phase precipitate particles that effectively restricts dislocation movement within the alloy. After preaging, without changing the temperature from 163° C., the plate-section was then press-forged in a 3.250-in. long, 1.125-in. wide, 1.062-in. deep rectangular die heated to the preaging temperature. The press-forging process deformed the plate-section so as to completely fill out the die cavity and provide a reduction in height of about 30%. Thereafter, the forged billet was post-deformation aged for one hour at 190° C. to complete the precipitation reaction(s) occurring in the alloy. Preaging and post-deformation aging were conducted in an oil bath.

Another forged billet was then fabricated from a substantially identical rolled plate-section made of 2219 aluminum alloy using the same time intervals and temperature values as above, but using a plate section whose height dimension provided a forging reduction of about 40%. A third forged billet was then fabricated, likewise from a substantially identical rolled plate-section made of 2219 aluminum alloy using the same time intervals and temperature values as above, but using a plate section whose height dimension provided a forging reduction of about 50%. These other forged billets were likewise post-deformation aged for one hour at 190° C.

In Table I, the tensile properties of a 2219 aluminum alloy die forging as fabricated in the conventional manner are compared with the tensile properties of the three forged billets fabricated according to the thermomechanical forging procedure of the present invention.

TABLE I

TENSILE PROPERTIES OF 2219 ALUMINUM ALLOY FORGINGS

| Forging Method | Forging Reduction | Ultimate Strength (ksi) | 0.2% Offset Yield Strength (ksi) | Elongation |
|---|---|---|---|---|
| Thermomechanical | 30% | 72.2 | 63.4 | 10.5% |
| Thermomechanical | 40% | 71.1 | 61.9 | 11.0% |
| Thermomechanical | 50% | 71.2 | 62.2 | 11.5% |
| Conventional* | — | 58.0 | 38.0 | 10.0% |

*Solution heat treated at 535° C., water quenched, and aged 26 hours at 190° C. (Aluminum Standards and Data, Fourth Edition, The Aluminum Association, New York, 1974-75, p. 184)

In a similar test, a small rolled plate-section made of 6061 aluminum alloy was solution heat treated for one hour at 532° C., water quenched, and then preaged for one hour at 163° C. to develop a dispersion of second-phase precipitate particles that effectively restricts dislocation movement within the alloy. After preaging, without changing the temperature from 163° C., the plate-section was then press-forged in a 3.250-in. long, 1.125-in. wide, 1.062-in. deep die heated to the preaging temperature to acquire the shape of a rectangular billet, with a reduction in height of 10%. No post-deformation aging procedure was applied to the forged billet.

Thereafter, a second, a third, a fourth and a fifth plate-section were solution heat treated, water quenched, and preaged for the same time interval and at the same temperature. These other preaged plate-sections were then likewise isothermally press-forged; the second with a forging reduction of 20%, the third with a forging reduction of 30%, the fourth with a forging reduction of 40%, and the fifth with a forging reduction of 50%.

In Table II, the tensile properties of a 6061 aluminum alloy die forging as fabricated in the conventional manner are compared with the tensile properties of the five billets fabricated according to the thermomechanical forging procedure of the present invention.

TABLE II

TENSILE PROPERTIES OF 6061 ALUMINUM ALLOY FORGINGS

| Forging Method | Forging Reduction | Ultimate Strength (ksi) | 0.2% Offset Yield Strength (ksi) | Elongation |
|---|---|---|---|---|
| Thermomechanical | 10% | 50.3 | 45.0 | 7.0% |
| Thermomechanical | 20% | 54.0 | 48.7 | 8.5% |
| Thermomechanical | 30% | 54.2 | 50.5 | 8.0% |
| Thermomechanical | 40% | 54.1 | 49.4 | 6.5% |
| Thermomechanical | 50% | 58.9 | 55.5 | 6.0% |
| Conventional* | — | 38.0 | 35.0 | 10.0% |

*Solution heat treated at 529° C., water quenched, and aged 8 hours at 177° C. (Aluminum Standards and Data, Fourth Edition, The Aluminum Association, New York, 1974-75, p. 184)

The data in Table I for 2219 aluminum alloy indicate that the thermomechanical forging technique of the present invention promotes a dramatic increase in strength while maintaining a level of ductility comparable to that of conventional forgings heat-treated to the T6 temper. In general, the tensile properties of thermomechanically forged 2219 aluminum alloy closely approximate the tensile properties of conventional 7075-T6 high-strength aluminum alloy forgings. Other experiments have shown that the level of ductility for 2219 aluminum alloy can be maintained substantially constant down to a forging reduction of about 20%. As shown in Table I, the other tensile properties remain essentially constant, independent of the degree of forging reduction, which indicates that complex-shaped forgings would exhibit unifrom properities.

The data in Table II for the 6061 aluminum alloy likewise indicate that the thermomechanical forging technique of the present invention promotes a dramatic increase in strength while maintaining a level of ductility comparable to that of conventional forgings heat-treated to the T6 temper.

The new thermomechanical forging technique of the present invention is applicable to other precipitation-hardenable aluminum alloys of the 2000, 6000 and 7000 series. In general, it is applicable to alloys in which a second-phase precipitate forms from a supersaturated solid solution upon aging following solution heat treatment.

The total processing time required for the thermomechanical forging technique of the present invention is only a small fraction of the processing time required by conventional forging techniques, thereby providing significant savings in operating expenses and energy consumption. Since solution heat treatment is carried out prior to forging in the thermomechanical technique of the present invention, distortions due to thermal treatments that occur after the forging (i.e., the working) in the prior art are eliminated by the present invention. Thus, the need for coining or straightening operations is substantially reduce by the present invention.

The present invention has been described above in terms of particular alloys of aluminum, which are representative of precipitation-hardenable systems. The particular examples of alloys discussed above are merely illustrative of the invention, which is defined more generally by the following claims and their equivalents.

I claim:

1. A method for forging a precipitation-hardenable aluminum alloy workpiece, said method comprising sequential performance of the steps of:

(a) solution heat treating said workpiece to produce a substantially homogeneous supersaturated solid solution of said alloy throughout said workpiece;

(b) aging said workpiece at an aging temperature at which second-phase precipitate particles form in said workpiece, said aging temperature being lower than said solution heat treating temperature, said aging of said workpiece being a partial aging which continues only until said percipitate particles acquire a size sufficient to restrict dislocation movement in said workpiece without substantially hindering workability of said alloy; and (c) mechanically working said workpiece substantially isothermally at said aging temperature to increase solute diffusion rates within said alloy, thereby accelerating nucleation and growth of said percipitate particles to an optimum size for strengthening said alloy.

2. The method of claim 1 comprising the additional step of further aging said workpiece after said workpiece has been mechanically deformed by working, said further aging serving to complete the formation of said percipitate particles in said workpiece.

3. The method of claim 1 wherein said partial aging of said workpiece continues for a time between approximately 0.5 hour and 1.5 hours.

4. An article manufactured from a precipitation-hardenable aluminum alloy workpiece by a process comprising the steps of:

(a) solution heat treating said workpiece to produce a substantially homogeneous supersaturated solid solution of said alloy throughout said workpiece;

(b) aging said workpiece at an aging temperature at which second-phase precipitate particles form in said workpiece, said aging temperature being lower than said solution heat treating temperature, said aging of said workpiece being a partial aging which continues only until said precipitate particles acquire a size sufficient to restrict dislocation movement in said workpiece without substantially hindering workability of said alloy; and (c) mechanically working said workpiece substantially isothermally at said aging temperature to increase solute diffusion rates within said alloy, thereby accelerating nucleation and growth of said precipitate particles to an optimum size for strengthening said alloy.

5. The article of claim 4 wherein said process comprises the additional step of further aging of said workpiece after said workpiece has been mechanically worked.

6. The article of claim 4 wherein said partial aging of said workpiece continues for a time between approximately 0.5 hour and 1.5 hours.

7. The article of claim 6 wherein said further aging of said workpiece after said workpiece has been mechanically worked continues for a time between approximately 0.5 and 2.0 hours.

8. The article of claim 4 wherein said alloy is 2219 aluminum alloy, and wherein said partial aging of said workpiece continues at a temperature of approximately 163° C. for approximately one hour.

9. The article of claim 4 wherein said alloy is 6601 aluminum alloy, and wherein said partial aging of said workpiece continues at a temperature of approximately 163° C. for approximately one hour.

* * * * *